United States Patent [19]

Houck

[11] 4,009,544

[45] Mar. 1, 1977

[54] DRILLING RIG WITH IMPROVED MAST SUPPORT STRUCTURE

[75] Inventor: Theodore B. Houck, Tulsa, Okla.

[73] Assignee: Parker Drilling Company, Inc., Tulsa, Okla.

[22] Filed: July 7, 1975

[21] Appl. No.: 593,635

[52] U.S. Cl. ..... 52/120; 173/151

[51] Int. Cl.[2] ..... E04H 12/34

[58] Field of Search ..... 52/116–120, 52/299; 173/151

[56] References Cited

UNITED STATES PATENTS

| | | | |
|---|---|---|---|
| 2,300,480 | 11/1942 | Woolslayer et al. | 52/299 X |
| 2,403,080 | 7/1946 | Hilborn | 52/116 X |
| 2,679,910 | 6/1954 | Moore | 52/116 |
| 3,807,109 | 4/1974 | Jenkins | 173/151 |

*Primary Examiner*—Ernest R. Purser
*Assistant Examiner*—William F. Pate, III
*Attorney, Agent, or Firm*—Head, Johnson & Chafin

[57] ABSTRACT

An improved portable drilling rig for drilling deep boreholes in the earth, in which the mast is rotatable to a horizontal position at a small distance above the ground. The mast is of rectangular construction, with four corner columns, and four support legs. While the mast is supported in a vertical position with four shoes, it rotates about the two back supports.

The mast is supported on two longitudinal stiffening members, of a U shape in cross-section. When the mast is lowered to a horizontal position, the front supporting columns drop below the top surface of the U shaped stiffening members and rest on the shallow bottom of the space between the two arms of the U. This puts the bottom of the mast within a foot or two above the ground, so that workmen may find it convenient to do work on the mast itself.

4 Claims, 3 Drawing Figures

DRILLING RIG WITH IMPROVED MAST SUPPORT STRUCTURE

CROSS-REFERENCE TO RELATED APPLICATION

This is one of two applications of the same inventor, filed on the same data in the United States Patent Office. The other application is entitled: DRILLING RIG WITH INDEPENDENT TABLE STRUCTURE.

BACKGROUND OF THE INVENTION

This invention lies in the field of drilling rigs. More specifically, it is concerned with drilling rigs for drilling deep boreholes in the earth, such as for the production of oil and gas.

Still more particularly, this invention lies in the field of portable drilling rigs which can be broken down into small components for ease of transportation.

The invention concerns principally the design of the structural base for the drilling rig such that it has sufficient longitudinal rigidity, and still supports the mast, while in a horizontal position, at a level close to the top surface of the ground. Furthermore, it has a working table or floor, of requisite height, which supports the rotary table, and which is narrower than the base of the mast and can be positioned on the structural base either before or after the mast is in position, and whether the mast is in a lowered or a raised position. The table structure is broken into a plurality of parts, each of which are fitted into the structural base and can be assembled in a lowered position and then rotated and raised into the final operating position.

When the mast is in a raised position, additional support for the mast is provided by an A frame which is behind the mast and serves as a means for raising the mast by cable means over a pulley at the top of the A frame.

There is an additional feature of this invention which involves the support of the floor of the rig or the work table on which are mounted the rotary table, draw works, etc. In conventional designs such as illustrated in the Jenkins et al patent U.S. Pat. No. 3,262,237, the floor is broken into two parts, one part of which is supported on the A frame and the other part of which is supported on the mast. When the mast is in a raised position, the two portions of the floor or table will match, providing continuous surface. However, because of the break between the two portions of the table, the part of the table on which the rotary table is supported, which should be directly under the center line of the mast, must be supported off center on one or the other of the two tables.

In the prior art, there are many designs of drilling rigs of this general type, however, most of them have the tiltable or hinged mast, and A frame for raising the mast, supported on the work floor or table, which is part of a very large base structure, some 10–20 feet high. These masts terminate in two legs which rotate about shoes attached to the work floor on the top of the base structure. Masts, with two legs (rather than four legs as in this invention) must depend a large extent on lateral support from the A frame, which must be built stronger to provide this support.

Also, because of the two legs, the full weight on the crown block is supported at two points on the base structure supporting the mast. Thus the base structure must be designed to spread this force over a large area of the earth.

When the mast is hinged at the level of the working floor, which may be from 10–20 feet above the ground, and lowered to the ground, it is very difficult to assemble the parts of the mast on the ground and then raise the base end to the shoe supports on the working floor.

SUMMARY OF THE INVENTION

It is a primary object of this invention to provide an improved design of drilling rig that has a number of advantages over the prior art designs.

It is a further object of this invention to provide a drilling rig construction in which the mast is supported at four widely spaced points upon a structural frame. These four points are not necessarily at the same elevation, however, two of them, the rear supports are at an elevation such that, as the mast is rotated down from a vertical position, the front columns of the mast will be at a low level, approaching within a foot or so of the earth's surface.

It is a further object of this invention to provide an improved drilling rig in which the floor of the rig or working table is self-supported directly on the structural base, and is of narrower width than the width of the mast so that the table can be positioned on the base independently of the presence of the mast, or whether it is in a lowered or raised position. The lowest cross-bracing of the mast is above the level of the table so that the mast can be raised or lowered while the work table is in position.

The work table can be disassembled into a plurality of parts, each of which can be separately installed, and coupled together after installation on the structural base. They can be installed in a lowered position and then raised by being rotated around two support points until they are in their final position.

The rotary table can be installed on the work table at the proper selected point so that it is vertically below the crown block.

The A frame which is used to lift and lower the mast is likewise of considerable width so that it is assembled over and around the table. However, since the table is of rigid construction, since it must support the full weight of the pipe in the rotary table, an improved modification, or embodiment of this invention, lies in supporting the A frame from the table, since the mast is supported at four widely spaced points and it is substantially stable in the raised position.

These and other objects are realized and the limitations of the prior art are overcome in this invention by providing a portable deep drilling rig in which a large structural steel base of the rig is formed by welding and plate construction. The principal longitudinal supports for the base are a pair of box sections running the full length of the base, one on each side of the base. These are built in a U cross-section.

The mast straddles the base and the two sides are directly over the center of the lateral stiffening U box sections. There are gusset plates mounted on top of the individual arms of the box sections, and they rise to the point where the base of the mast, terminating in bearings, is pinned to the gusset plates, or shoes.

Since the two supports for each of the bearings that support the four legs of the mast rest on the two arms of the box sections, there is sufficient space between the arms, so that when the mast is lowered to a horizontal position, it can be lowered down into the space within the U sections. This bottom portion is a shallow box, which may be no more than a foot or so above the ground. Thus, when the mast is lowered, the front columns of the mast rest on the floor of the space between the two arms of the box sections. The mast is then a foot or so above the ground, so that workmen can reach and work on portions of the mast as needed, particularly in the coupling of the principal sections of the mast, threading cable, and attaching other features, etc.

An A frame is provided behind the mast and its outer legs are attached to the outer of the two arms of the box sections. The inner of the two arms of the box sections supports the floor of the rig, or the work table. The width of this support is less than the width of the A frame and the mast. Thus, the table can be assembled inside of the mast, or it can be assembled while the mast is in a lowered position or it can be assembled before the A frame and the mast are attached to the base frame.

Having a work table, or floor, which is assembled to the structural base independently of the mast and the A frame, there is full freedom to position the rotary table at the most desirable point directly under the crown block.

BRIEF DESCRIPTION OF THE DRAWINGS

These and other objects and advantages of this invention and a better understanding of the principles and details of the invention will be evident from the following descriptions taken in conjunction with the appended drawings in which.

DESCRIPTION OF THE PREFERRED EMBODIMENT

Figure 1:
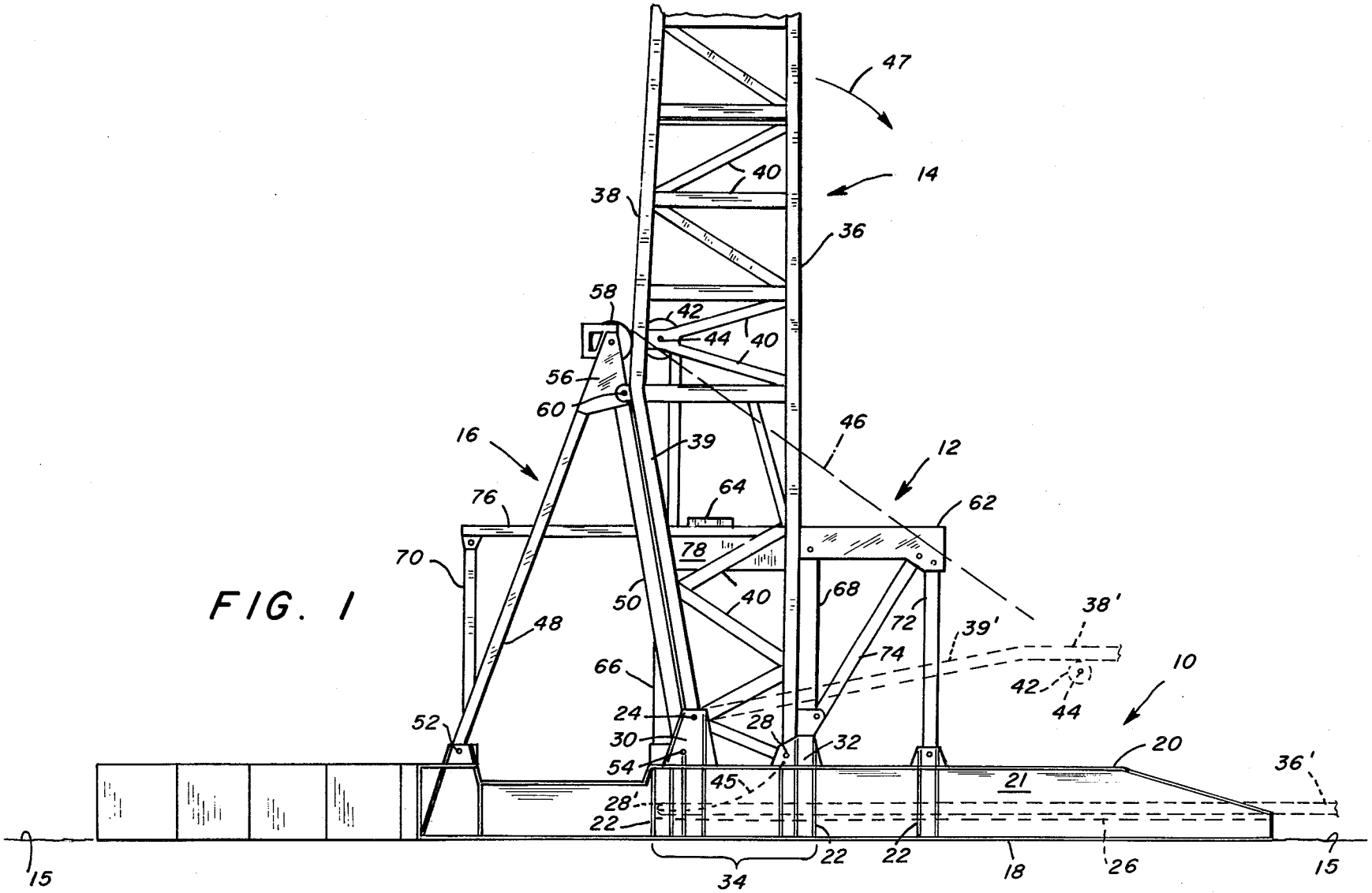
FIG. 1 shows an overall side view of the drilling rig including the structural base, the mast, the A frame, and the work table.

Referring now to the drawings and in particular to FIG. 1, there is shown by the numeral 10 a general view of the structural base of the drilling rig. Numeral 12 indicates generally the work table or the floor of the rig. Numeral 14 indicates generally the mast of the drilling rig, and numeral 16 indicates generally the A frame.

Figure 3:
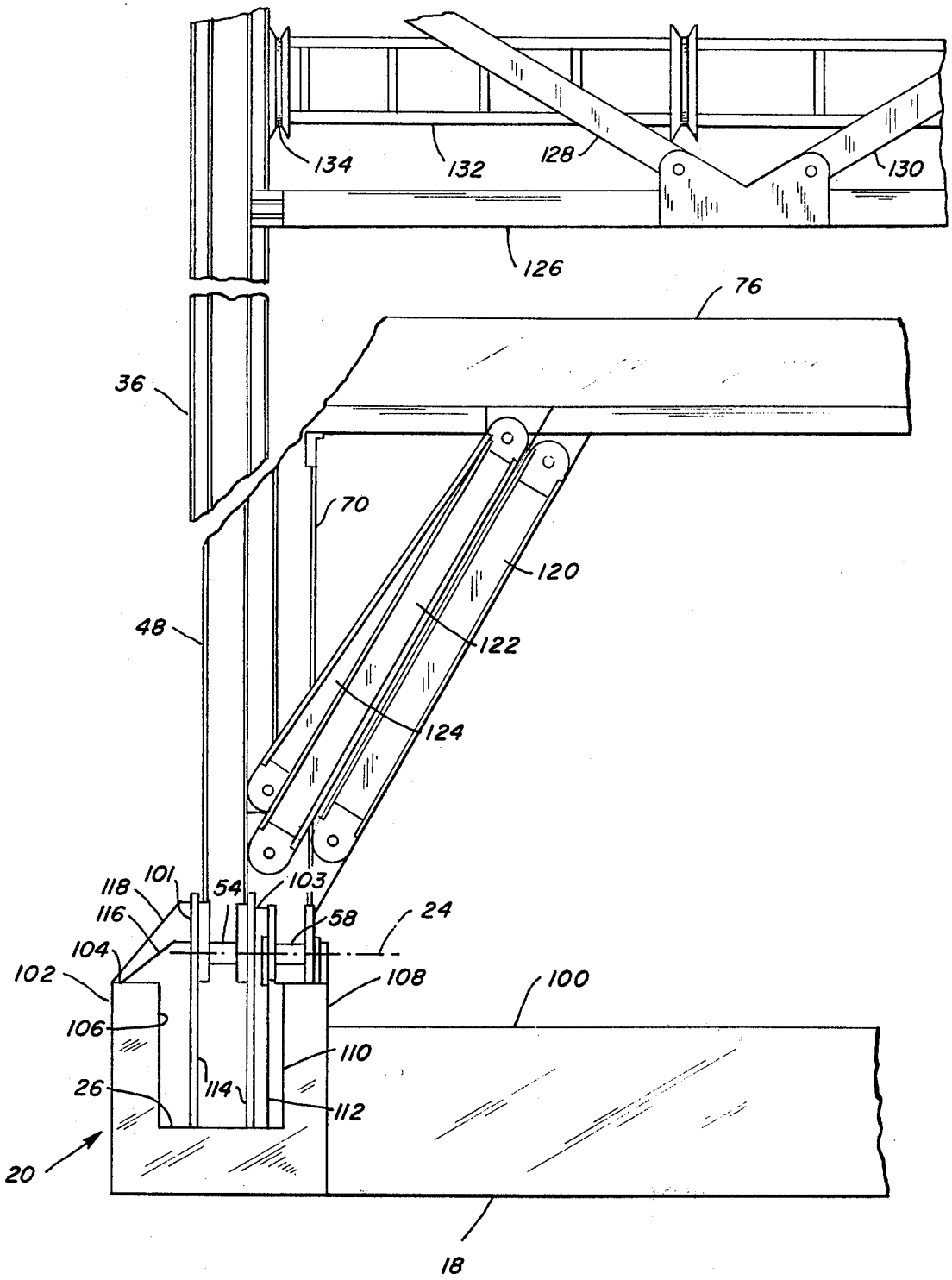
FIG. 3 is a view of the rig showing the construction of the principal box sections which provide the longitudinal rigidity, and showing the relative positions of the legs and cross-bracing of the mast, the legs of the A frame, and legs of the work table, and the transverse bracing of the A frame and the work table.

The base 18 of the structural frame 10 rests on the ground surface 15. This frame, as shown in FIG. 3, is made up of four vertical box sections, two on each side of the frame with a low central part 26, which provides a cross-section roughly in the shape of a U. This shape is a very important feature of the design. It provides adequate longitudinal rigidity to the base, and supports the mast at some distance above the ground. It also makes provision for tilting the mast into a horizontal position, wherein the mast rests on the bottoms of the U portions. These box sections 20, particularly in the region 34, near the center of the base, and directly under the mast and the rotary table, have numerous gusset plates 22 to stiffen the vertical plates 21 that form the walls of the box sections.

The mast 14 has two front columns 36 and two back columns 38. The front columns are supported on pins 28 in a fabricated structure 32 welded to the top of the arms of the box sections. The back columns 38 are formed into sloping columns 39, which narrows the fore and aft dimension of the mast. The back legs 39 are hinged at the axis 24 in another pair of supports 30 which are attached to the arms of the box sections.

Referring briefly to FIG. 3, it is seen that the box sections indicated generally by the numeral 20 have a cross-section similar to that of a U. There are two vertical box sections. One has walls 102 and 106 and top 104, the other vertical box section has outer and inner walls 108 and 110, respectively. There is a bottom portion of the U having a top surface 26 and, of course, the bottom plate 18 of the whole base closes off the box 20.

There are heavy vertical plates 101 and 103 that are supported from plates 26 and 18, and are further gusseted by plates 116 and 118, etc. These plates 101 and 103 are reinforced and form the pivots for the axis 24 about which the mast will be supported and rotate from a vertical position to a horizontal position, shown in dashed line 36', 38' and 39'.

When the mast is in a vertical position it takes support through the axes 24 and 28 directly to the steel structural plates 30 and 32, which are welded into and are part of the box sections, and the entire frame 10. Since the full weight on the crown block and cable falls in the middle of the mast when it is in a raised position, the greatest strength is needed in the part of the frame indicated generally by the bracket 34.

When the mast is to be lowered, the pin at 28 is removed and the mast is allowed to rotate in the direction of the arrow 47, into the horizontal position shown by the numbers 36', 38' and 39'. Shown in dashed line 26 is the plate which forms the bottom of the trough between the two vertical box sections. This surface 26 is approximately 1.5 feet above the ground surface 15. Therefore, when the mast is in a lowered position, the bottom column 36 is about 1.5 feet above the ground.

In the prior art systems, where the mast is rotated about an axis 10–20 feet above the ground, when the top of the mast reaches the ground, parts of the mast may be as much as 30 feet above the ground, making it difficult for workmen to reach the parts to work on them.

Considering that the point 28 and 24 are in the range of 8' to 10' above the ground, if the mast were to be rotated about the front support 28 when it is in a horizontal position, the bottom of the mast would be some 8' to 10' above the ground surface and the top parts 18–20 feet. This would make it very inconvenient for workmen to assemble the mast out of its various components and to do work as necessary. Consequently, the feature of having a structural block section in the form of a U with the support for the mast centralized over the space in the U and rotating the mast about the back bearing support, so that in a horizontal position the front of the mast would be at the level of the base of the U, and therefore at almost ground level, is very important.

There is an A frame indicated generally by the numeral 16 which has front legs 50 and back legs 48 and which straddles the work table, indicated generally by the numeral 12. The A frame is attached to the structural base by means 52 and 54, etc. At the top of the frame there is a sheave 58, over which a cable indicated as a dotted line 46 can be run. This cable is attached over a sheave 42 in the mast, or can be attached to the mast directly. However, it is preferred to attach the cable to the A frame and carry it around the sheave 42, which is journalled in the mast at point 44.

By pulling back on the cable 46, that is, pulling the mast to the rear, weight can be taken off the pin 28 so that these pins can be removed. Since the center of gravity of the mast is in front of the pin 24 the mast will then tend to fall and can be lowered by means of the cable 46 until it is in a horizontal position, and resting on the floor 26 of the U portion of the longitudinal box sections 20.

Shown generally by the numeral 12 is the work table or floor of the rig, and the numeral 64 indicates generally the rotary table which would be positioned on the center of the mast. Details of the table 12 will be provided in connection with FIG. 2. However, in general, the table can be made of one or more parts 76, 78, 62 which can be assembled in pieces, and then placed in position on the base frame, and then all parts folded and fastened together, so that it provides a rigid support for the rotary table. Very rigid columns 66 and 68 are provided between the work table and the base frame. These are supported on the box sections 20 as will be shown in FIG. 3.

Figure 2:
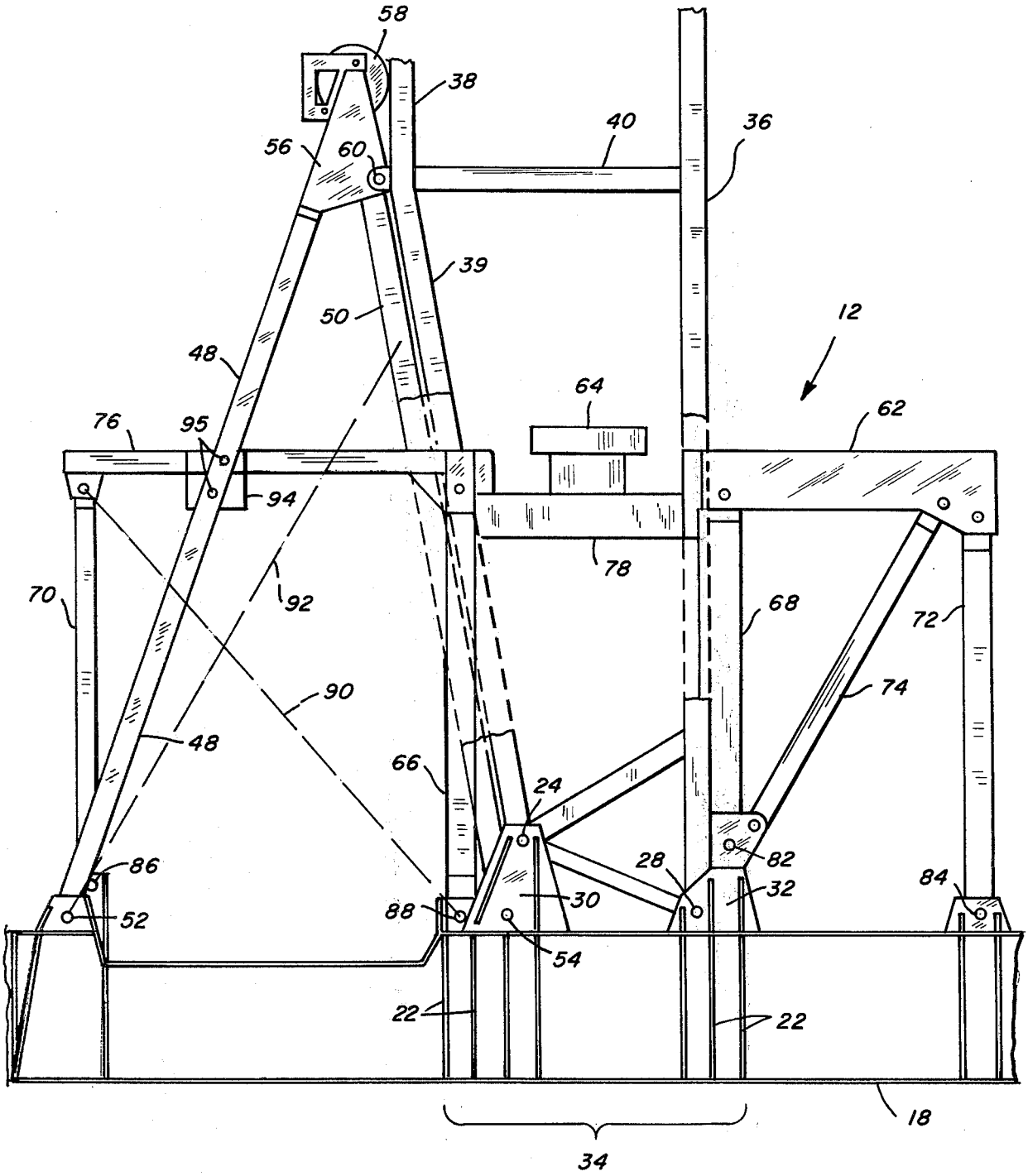
FIG. 2 is an enlarged view of the central part of the base showing in more detail the attachment and support of the mast to the base frame, the attachment and support of the A frame from the structural base, and the construction of the work table.

Referring now to FIG. 2 there is shown an enlarged view of the central part of the base frame of FIG. 1. Part of the structure 39 and 36 of the mast is cut away, and part of the structure 50 of the A frame is cut away, so that more detail can be shown of the work table 12. There is a front section 62 and a back section 76 which are of the same level. If desired, the middle section 78, which supports the rotary table can be supported below the parts 62 and 76 so that the rotary table will be approximately at the level of the floor 62, 76.

The part 62 can be assembled on the ground in position, such that it can be rotated either about the pin or axis 82 or 84, and lifted by rotation around either of these pins, until it is in a vertical position, at which time the other pins are put in place, and that portion of the floor or table is completed. Similarly the back portion 76 which conceivably would have additional cross-braces such as indicated by the dashed line 90, for example. Again this could be rotated either about the pins 86 or 88 and put into position that way.

The central section 78 can be constructed to be supported at its two ends on the parts 76 and 62. It can be lifted into position after the front and back parts are assembled. If the mast is already in a raised position, of course, the crown block can be used for the lifting purposes, or other lifting means can be used.

In FIG. 2 the construction is shown of the base frame, and the gusset plates 22 on the outside the structures 30 and 32, which support the four corners of the mast at pins 24 and 28.

While the back supports 68 of table 62 seem to be in the plane of the mast it will be clear from the description of FIG. 3 that the legs 68 and 72 of the table are supported on the inner arm of the box section, whereas the mast itself is supported over the middle of the total box section. Therefore, there is lateral clearance between the side walls of the mast and the side walls of the table 62.

The legs 70 and 66 of the back portion 76 of the table are also supported on the inner arms of the two box sections.

Referring now to FIG. 3 there is shown a transverse view of the drilling structure. The structural base has transverse beams indicated by the numeral 100 which are box sections having the same base plate 18, as do the longitudinal box sections 20, having outer walls 102 and 108 and inner walls 106 and 110 and inner floor 26.

In FIG. 3, there are two parts shown. The upper part shows the cross-bracing 126 of the mast, where 36 illustrates one column of the mast. The column 36 is supported directly over the plates 101 and 103, which are welded into the box sections in the form of plates 114, supported by lateral gussets 116, 118, etc. The view of the mast with its cross-bracing 126 and angle braces 128 and 130, etc. is taken from a view in front of the table 62. The lowest cross-brace 126 is well above the level of the table 76 so that the mast 14 can be lowered without interference, even though the table 62 is in position. There is a cross support 132 which supports a number of sheaves, 134, etc. such as indicated in FIG. 1 by the sheave 42, which is used to raise and lower the mast. It will be clear from FIG. 2 that the legs of the mast are supported directly over the center of the box section 20.

The lower part of FIG. 3 is taken at a cross-section which shows the back part of the A frame and the back part of the table 76. The columns 48 indicate the legs of the A frame which is supported at pins 52 and 54, which is over the center of the box section 20. The legs 70 of the table 76 is supported over the inner arms of the box sections, having an outer wall 108 and an inner wall 112. It will be seen that the width of the inner box section 108, 112 is wider than the box section 108, 110. The extra width of the U space is needed in front of the pivot 24. However, back of the pivot, the space inside of the U can be reduced, giving a broader support to the box section 108, 112 for supporting the legs 70 and other legs of the table 76.

Since there is no lateral movement of the A frame 16 with regard to the table 76 there can be lateral bracing between the legs 48 and 50, and the table 76, and also lateral bracing between the legs 66 and 70 of the table, to the table 76. These are shown in a general way by means of the angle braces 120, 122, 124, and are conventional in the sense of being structural braces.

Referring back to FIG. 2, there is a dashed line 92 running from the pivot pin 52 up to the leg 50. There is a gusset plate system 94 with pins 95 or bolts, such that the A frame can be in the form of a triangular girder from point 52 to the block support 56 and a portion of arm 50, with suitable cross-bracing in between, which is not shown. In other words, since the table construction is going to be sufficiently well braced and rigid enough to carry the full weight of the drill pipe there is no need of having a full A frame, but simply a column or girder which is supported at 52 at which is attached at points 95 to the table 76.

The design of the improved drilling rig has been discussed in detail. However, it may be well to summarize the important design features.

The first is the design of the base structure which has longitudinal box sections in the form of a U. The support for the outer legs of the mast is directly over the center of the U so that as the mast is lowered, it is rotated about the rear supports, and the front legs are then lowered into position inside of the U, and rest on the floor of the U shaped box sections. This places the mast as low to the ground as is possible, so that workmen can work on assembling the portions of the mast, threading cables and doing other necessary work without resorting to tables, ladders or carriages, or other means of reaching to great height. This feature of lowered height of the mast when in the horizontal position is achieved by having the mast support at two relatively widely space axes, and rotating the mast about a high back axis, so that when in a horizontal position the front of the mast will be substantially equal in elevation to the base of the U.

Another feature of the invention lies in the use of a separately supported table which is narrower than the width of the mast, and is supported on the inner arms of the U, on each side of the base frame. This provides lateral clearance between the inner edges of the mast columns, and the outer edges of the table. The table can be constructed of a plurality of parts such as 3, for example, with a separately supported front part, and rear part, separately installed in pinned positions onto the base frame. A third part can be then spanned between and supported from the front and rear parts of the table, with its surface lowered to the point that the top of the rotary table is in a convenient elevation.

Another portion of the invention relates to the use of an A frame which spans outside of the table so that the table can be put into position after the mast and A frame are supported on the base frame.

Conversely, it is possible to support the A frame as a simple girder attached to the table and therefore simplify the construction. This can be done since the design of the mast is such that it has a wide base support and only small lateral forces are required to retain it in a vertical position.

While the invention has been described with a certain degree of particularity, it is manifest that many changes may be made in details of construction and the arrangement of components. It is understood that the invention is not to be limited to the specific embodiment set forth herein by way of exemplifying the invention, but the invention is to be limited only by the scope of the attached claim or claims, including the full range of equivalency to which each element or step thereof is entitled.

I claim:

1. In a rotary drilling system having a tilting mast, the improvement comprising:

a. a pair of paralleled longitudinal members forming a base supported on the ground, each member being fabricated as a box section in the shape in vertical cross-section of an open top U;

b. four pairs of paralleled spaced vertical support plates centered over and affixed to said U members and rising above the tops of said U members;

c. a mast having two front and two rear corner columns, arranged in a rectangular horizontal cross-section, the lower end of each of said columns being pinned to a said pair of support plates and centered over said U-shaped members; and d. means to tilt said mast forward about a horizontal axis through the pins in said rear columns;

whereby as said mast tilts forward the lower portion of the front columns will be received within said U-shaped stiffening members so that when the mast is horizontal the front columns are at a height above the ground less than the height of the top of said longitudinal members.

2. The drilling system as in claim 1 including:

an A frame supported on said base behind said mast, the A frame having two inclined forward columns and two inclined rearward columns, the lower ends of the forward columns being supported adjacent said rearward columns of said mast;

sheave means at the top of said A frame means; and cable means over said sheave means to raise said mast from a horizontal to a vertical position and vice versa.

3. The drilling system as in claim 2 in which said cable means includes two sheave and cable means spaced apart from each other and approximately centered over said stiffening members.

4. The drilling system as in claim 1 in which said pins supporting said mast front corner columns are of a lower elevation than said pins supporting said mast rear corner columns.

* * * * *